US009456719B2

(12) United States Patent
Foster et al.

(10) Patent No.: US 9,456,719 B2
(45) Date of Patent: Oct. 4, 2016

(54) AUTOMATIC TOILET FLUSHING SYSTEM

(71) Applicants: Erik Robertson Foster, Maple Park, IL (US); Benjamin Robert Gardner, St. Charles, IL (US)

(72) Inventors: Erik Robertson Foster, Maple Park, IL (US); Benjamin Robert Gardner, St. Charles, IL (US)

( * ) Notice: Subject to any disclaimer, the term of this patent is extended or adjusted under 35 U.S.C. 154(b) by 0 days.

(21) Appl. No.: 14/282,784

(22) Filed: May 20, 2014

(65) Prior Publication Data

US 2015/0335216 A1 Nov. 26, 2015

(51) Int. Cl.
*A47K 13/10* (2006.01)
*E03D 5/09* (2006.01)

(52) U.S. Cl.
CPC ..... *A47K 13/10* (2013.01); *E03D 5/09* (2013.01)

(58) Field of Classification Search
CPC ..... A47K 13/10
USPC ..... 4/246.1–246.5
See application file for complete search history.

(56) References Cited

U.S. PATENT DOCUMENTS 4,017,916 A * 4/1977 Pearson ..... E03D 9/052 4/213
5,400,446 A * 3/1995 Bloemer ..... E03D 5/10 4/250
2008/0083057 A1* 4/2008 Jung ..... A47K 13/10 4/246.1

* cited by examiner

*Primary Examiner* — Lori Baker

(57) ABSTRACT

A universal flushing lever for a toilet that can be mounted on different areas of the toilet tank, during flushing action, triggers the closing of the toilet seat cover and or seat using magnetic fields. A magnet is attached to a universal flushing lever as well as the seat cover and/or seat. When the flushing lever is actuated it uses the magnet's fields to trigger the cover and/or seat closure. The magnets can be positioned to use the magnetic fields in two ways, repulsion or attraction individually or in conjunction. In the repulsion scenario, the magnets, one positioned on the flushing lever and one on the cover and or seat, once in proximity forces the closure of the adjacent cover and or seat. In the attraction scenario, the magnets, one positioned on the flushing lever and one on the cover and or seat, once away from proximity allows the closure of the adjacent cover and or seat. This system allows adjustment of the magnets to a variety of preexisting tanks and toilets for effective retrofitting as well as new designs. This application can be used as a kit or embedded in design intended with new toilets.

1 Claim, 1 Drawing Sheet

AUTOMATIC TOILET FLUSHING SYSTEM

FIELD OF THE INVENTION

This invention relates to flushing mechanisms for all toilets. In particular, the design provides the closure mechanism of a toilet seat cover and or seat, activated by a flushing action initiated by a universal lever which is suitable for being retrofit into existing toilets as well as embedded into new toilet designs.

BACKGROUND OF THE ART

Ensuring that the toilet seat is returned to the closed position after use of the toilet is a common dilemma. The commonly used two-part toilet seat includes a seating ring and cover, both hinged to the bowl.

It is often desired that the seat cover and seat be in a closed position after each use of the toilet. The closed cover enhances aesthetic qualities of the toilet, limits access to the liquid in the bowl, e.g., pets, children, and provides protection from objects from falling into the open bowl. Having a closed cover prevents particles from entering the atmosphere during the act of flushing, helping to keep a clean environment and stopping the spread of germs. Also, this closing of the seat and cover prevents a subsequent unwary person from inadvertently sitting directly on the toilet rim and or falling into the bowl.

SUMMARY OF THE INVENTION

This invention provides a mechanism for flushing a toilet, closing the cover and seat, all with one actuation of a universal flushing lever. In particular, the mechanism is suitable for retrofit into existing toilets as well as new designs.

Specifically, a magnet is attached to a universal flushing lever as well as a toilet seat cover or toilet seat. Using the same system, construction, material, and processes, but simply reversing the magnets polarities from push or repulsion to pull or attraction, two scenarios can be realized that can be used in conjunction or separately. The magnetic fields and corresponding polarities are used as mechanisms to release and trigger the closing of the toilet seat and toilet seat cover.

The first scenario, using the magnetic polarity resulting in repulsion; The universal flushing lever is actuated and during such event the magnet, positioned on the lever, reaches the proximity of the magnet that is positioned adjacent on the toilet seat cover and or toilet seat that are in the open position, resulting in the magnetic force or push that closes said seat cover and or seat.

The second scenario, using the magnetic polarity resulting in attraction (e.g. reversing the magnets in the existing system); The universal lever is actuated and during such event the magnet, positioned on the lever, is removed from the proximity of the magnet that is positioned adjacent on the toilet seat cover or toilet seat that is in the open position, resulting in a release from the magnetic pull, that closes the seat cover and or seat.

It is one intention of this invention, therefore, to encourage the closing of the toilet seat and toilet cover after use. The magnets use their magnetic fields as a force to close, or allow closure, of the toilet seat and cover. This event is initiated by the actuation of a universal flush lever or switch, thus requiring the closing of the toilet seat and toilet seat cover. Combining the functions of flushing and closing reduces the effort required to do both, further encouraging such process.

Other objects and advantages besides those discussed above will be apparent to those skilled in the art from the description of the preferred embodiment of the invention which follows. Thus, in the description, reference is made to the accompanying drawings, which form a part hereof, and which illustrate one example of the invention. Such example, however, is not exhaustive of the various alternative forms of the invention. Therefore, reference should be made to the claims which follow the description for determining the full scope of the invention.

DESCRIPTION OF PREFERRED EMBODIMENT

Figures 1, 2:
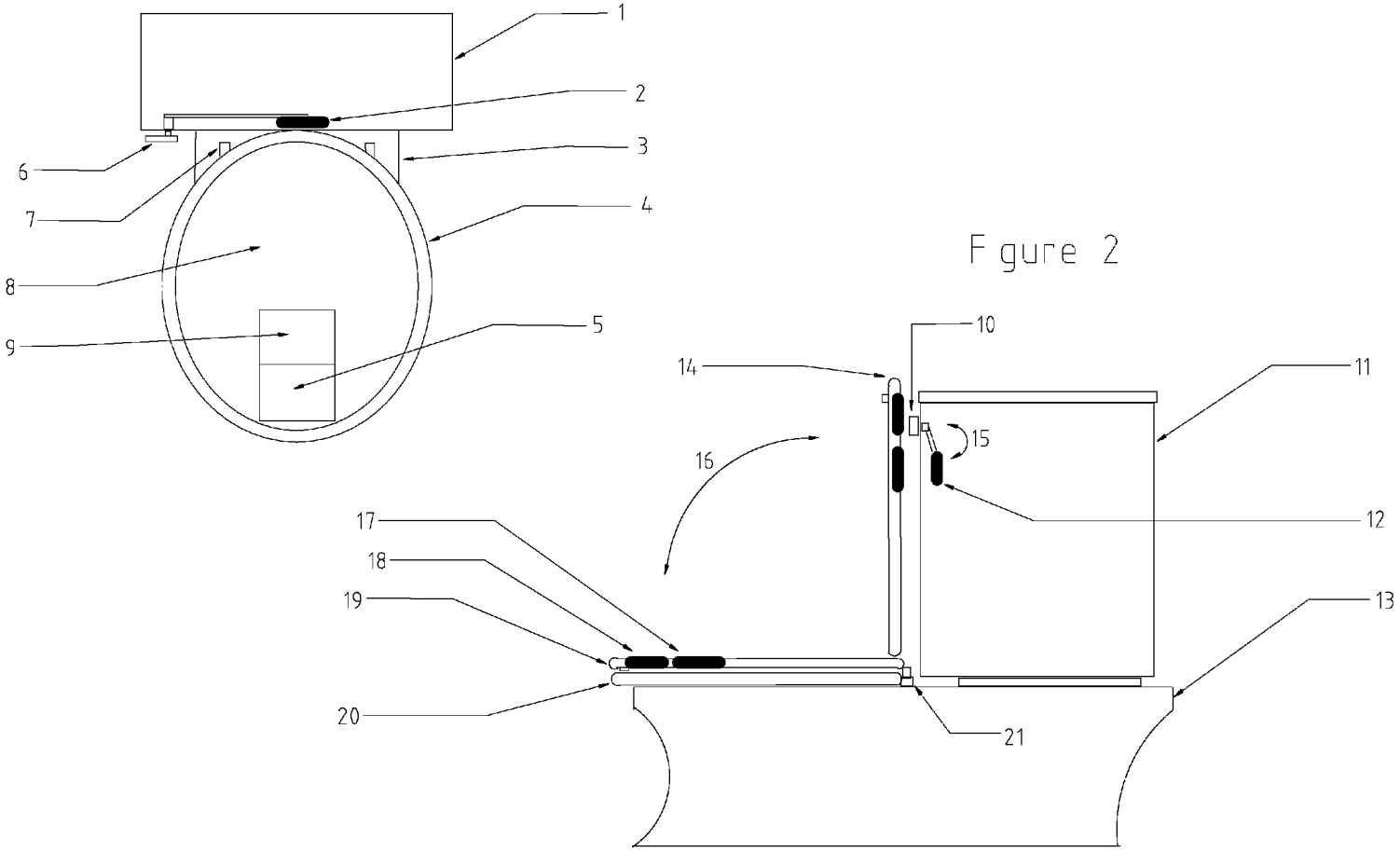
FIG. 1 is a view in elevation of a toilet with the seat and cover in the closed position.
FIG. 2 is a side view of a toilet with the seat and cover, in addition to the lever, with their respective positions before and after actuation.

Referring to FIG. 1, there is provided a tank-type toilet structured with a toilet base 3, toilet tank 1, and universal tank lever 6.

A toilet seat 4 and toilet cover 8 are held to the toilet base 3 using a toilet seat and toilet cover hinge 7 which allow for opening and closing.

A magnet is embedded on the magnet repulsion position area 5 with its polarity respective to the magnet lever attachment 2 polarity in regards to the intended repulsion effect.

A magnet, conversely, is embedded on the magnet attraction position area 9 with its polarity respective to the magnet lever attachment 2 polarity in regards to the intended attraction effect.

Referring now to FIG. 2, the tank-type toilet is viewed on its side to show the toilet open position 14 and the subsequent toilet closed position 19 after the initiation of a universal toilet tank lever 10 and the ensuing motion towards activation 15.

Thus when a tank lever 10, adjacent to toilet tank 11 on toilet base 13, is actuated the magnet lever attachment 12 leaves the proximity of the lower magnet attraction position area 17 reaching the magnetic field boundary of the upper magnet repulsion position area 18 pushing the open position toilet cover 14 resulting in toilet cover and toilet seat motion after universal tank lever actuation 16 and toilet seat cover closed position 19. In rare circumstances when only a toilet cover is not present the same application can be implemented using the toilet seat 20 using toilet seat and cover hinge 21.

We claim:

1. An Automatic Toilet Flushing System comprising:

a toilet having a hinged toilet seat moveable between up and down positions; and a hinged toilet seat cover moveable between up and down positions; and a toilet flushing lever upon initiation sets the sequence of closing the toilet seat cover or toilet seat using magnetic attraction and repulsion fields; and a magnet positioned toward the opposite end of the flushing lever where flushing is initiated; and a magnet mounted on the upper area of a toilet cover or seat in the toilet cover's absence, whereby said hinged toilet cover or toilet seat is in an open position uses magnetic polarity as repulsion in regards to said toilet flush lever magnet, and a magnet using polarity as attraction mounted vertically below said repulsion magnet whereby said hinged toilet cover or said toilet seat is in an open position uses magnetic polarity as attraction in regards to said toilet flush lever magnet thus after the toilet flushing lever's initiation said magnet leaves the attraction magnet's field releasing the magnetic pull, subsequently the toilet flushing lever magnet enters said repulsion magnet's field creating a push effect closing said toilet seat cover and or said toilet seat.

* * * * *